US009761360B2

(12) United States Patent
Takenaka et al.

(10) Patent No.: US 9,761,360 B2
(45) **Date of Patent: *Sep. 12, 2017**

(54) METHOD OF MANUFACTURING GRAIN ORIENTED ELECTRICAL STEEL SHEET

(71) Applicant: JFE Steel Corporation, Tokyo (JP)

(72) Inventors: Masanori Takenaka, Tokyo (JP); Toshito Takamiya, Tokyo (JP); Hiroshi Matsuda, Tokyo (JP)

(73) Assignee: JFE Steel Corporation (JP)

( * ) Notice: Subject to any disclaimer, the term of this patent is extended or adjusted under 35 U.S.C. 154(b) by 266 days.

This patent is subject to a terminal disclaimer.

(21) Appl. No.: 14/387,953

(22) PCT Filed: Mar. 29, 2013

(86) PCT No.: PCT/JP2013/002192

§ 371 (c)(1),
(2) Date: Sep. 25, 2014

(87) PCT Pub. No.: WO2013/145784

PCT Pub. Date: Oct. 3, 2013

(65) Prior Publication Data

US 2015/0332822 A1 Nov. 19, 2015

(30) Foreign Application Priority Data

Mar. 29, 2012 (JP) ..... 2012-077744

(51) Int. Cl.
*H01F 1/147* (2006.01)
*C21D 9/46* (2006.01)
(Continued)

(52) U.S. Cl.
CPC ..... *H01F 1/14775* (2013.01); *C21D 8/1222* (2013.01); *C21D 8/1233* (2013.01);
(Continued)

(58) Field of Classification Search
CPC ..... C21D 2201/05; C21D 8/12; C21D 9/46; H01F 1/14775
(Continued)

(56) References Cited

U.S. PATENT DOCUMENTS 3,932,234 A 1/1976 Imanaka et al.
4,302,257 A 11/1981 Matsumoto et al.
(Continued)

FOREIGN PATENT DOCUMENTS

JP 40-15644 7/1965
JP 51-13469 4/1976
(Continued)

OTHER PUBLICATIONS

European Extended Search Report dated Mar. 31, 2015 from corresponding European Patent Application No. EP 13 76 8554.
(Continued)

*Primary Examiner* — Weiping Zhu
(74) *Attorney, Agent, or Firm* — DLA Piper LLP (US)

(57) ABSTRACT

A method of manufacturing a grain oriented electrical steel sheet uses austenite (γ)-ferrite (α) transformation which develops excellent magnetic properties, uses $T_\alpha$ calculated from equation (1) and performs the first pass of rough hot rolling at a temperature of ($T_\alpha$−100)° C. or higher with a rolling reduction of 30% or more, and further uses $T_{\gamma max}$ calculated from equation (2) and performs any one pass of finish hot rolling in a temperature range of ($T_{\gamma max}$±50)° C. with a rolling reduction of 40% or more:

$$T_\alpha[°\ C.]=1383.98-73.29[\%\ Si]+2426.33[\%\ C]+271.68[\%\ Ni] \quad (1)$$

$$T_{\gamma max}[°\ C.]=1276.47-59.24[\%\ Si]+919.22[\%\ C]+149.03[\%\ Ni] \quad (2)$$

(Continued)

where [% A] represents content of element "A" in steel (mass %).

20 Claims, 3 Drawing Sheets

(51) Int. Cl.

| | |
|---|---|
| ***C22C 38/00*** | (2006.01) |
| ***C22C 38/16*** | (2006.01) |
| ***H01F 41/02*** | (2006.01) |
| ***C22C 38/60*** | (2006.01) |
| ***H01F 1/16*** | (2006.01) |
| ***C21D 8/12*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |

(52) U.S. Cl.
CPC ..... *C21D 8/1261* (2013.01); *C21D 9/46* (2013.01); *C22C 38/001* (2013.01); *C22C 38/008* (2013.01); *C22C 38/02* (2013.01); *C22C 38/04* (2013.01); *C22C 38/06* (2013.01); *C22C 38/08* (2013.01); *C22C 38/16* (2013.01); *C22C 38/60* (2013.01); *H01F 1/16* (2013.01); *H01F 41/02* (2013.01); *C21D 8/1266* (2013.01); *C21D 8/1272* (2013.01); *C21D 8/1288* (2013.01)

(58) Field of Classification Search
USPC ..... 148/111
See application file for complete search history.

(56) References Cited

U.S. PATENT DOCUMENTS

| | | | | |
|---|---|---|---|---|
| 5,296,050 | A | 3/1994 | Takamiya et al. | |
| 9,187,798 | B2 * | 11/2015 | Takenaka ..... | C21D 8/12 |
| 2013/0087249 | A1 | 4/2013 | Takenaka et al. | |
| 2013/0345243 | A1 | 12/2013 | Bouillot et al. | |

FOREIGN PATENT DOCUMENTS

| | | |
|---|---|---|
| JP | 54-120214 | 9/1979 |
| JP | 55-119126 | 9/1980 |
| JP | 59-93828 | 5/1984 |
| JP | 61-34117 | 2/1986 |
| JP | 2-101121 | 4/1990 |
| JP | 3-10020 | 1/1991 |
| JP | 5-306410 | 11/1993 |
| JP | 8-215710 | 8/1996 |
| JP | 2014-507453 | 3/2014 |
| WO | 90/13673 | 11/1990 |
| WO | 2011/158519 | 12/2011 |

OTHER PUBLICATIONS

European Communication dated Sep. 9, 2016, of corresponding European Application No. 13768554.1.

* cited by examiner

METHOD OF MANUFACTURING GRAIN ORIENTED ELECTRICAL STEEL SHEET

TECHNICAL FIELD

This disclosure relates to a method of manufacturing a so-called grain oriented electrical steel sheet having crystal grains with {110} plane in accord with the sheet plane and <001> orientation in accord with the rolling direction, in Miller indices.

BACKGROUND

It is known that grain oriented electrical steel sheets having crystal grains in accord with {110}<001> orientation (hereinafter, "Goss orientation") through secondary recrystallization annealing exhibit superior magnetic properties (e.g. see JP 540-15644B). As indices of magnetic properties of the grain oriented electrical steel sheets, magnetic flux density $B_8$ at a magnetic field strength of 800 A/m and iron loss (per kg) $W_{17/50}$ of the steel sheet when it is magnetized to 1.7 T in an alternating magnetic field with an excitation frequency of 50 Hz, are mainly used.

Further, it has been a common practice in manufacturing grain oriented electrical steel sheets to use precipitates called inhibitors to induce differences of grain boundary mobility during final annealing so that the crystal grains preferentially grow only in the Goss orientation.

For example, JP 540-15644B discloses a method of using AlN and MnS, while JP 551-13469B discloses a method of using MnS and MnSe. Both have been put into practical use industrially.

Since those methods using inhibitors require a uniform and fine precipitate distribution of inhibitors as an ideal state, it is necessary to heat a slab before hot rolling to 1300° C. or higher. As such high temperature slab heating is performed, excessive coarsening occurs in the crystal structure of the slab. With such coarsening, the orientation of the slab structure tends to grow in {100}<011> orientation which is a stable orientation of hot rolling, which greatly impedes grain growth during secondary recrystallization, thereby leading to serious deterioration of magnetic properties.

For the purpose of reducing the above coarse slab structure, JP H03-10020A discloses a technique of obtaining uniformly recrystallized microstructures by performing high reduction rolling at a temperature range of 1280° C. or higher in the first pass of rough rolling, thereby facilitating generation of recrystallization nuclei from grain boundaries of a grains.

For the purpose of recrystallization of the surface layer of the hot rolled sheet, JP H02-101121A discloses a technique of performing hot rolling with a rolling reduction of 40% to 60% in a temperature range of 1050° C. to 1150° C. using the rolls having surface roughness of 4 μmRa to 8 μmRa, to increase the amount of shear strain in the surface layer of the hot rolled sheet.

Further, JP S61-34117A discloses a technique to grow only highly oriented secondary recrystallized grains, by subjecting a silicon steel slab containing 0.01 wt % to 0.06 wt % of C to high reduction rolling of 40% or more in the first pass of finish hot rolling, and afterward to light reduction rolling of 30% or less per 1 pass so that Goss orientation grains existing in the surface layer of the hot rolled sheet increase. The Goss orientation grains lead to the increased amount of Goss orientation grains in the surface layer after primary recrystallization annealing through a so called "structure memory mechanism".

JP H03-10020A discloses high reduction rolling at a temperature of 1280° C. or higher in rough hot rolling. However, as a technical concept, this is originally high reduction rolling in an a single phase region, and there existed a problem that an (α+γ) dual phase is formed even at a temperature of 1280° C. or higher depending on compositions, so that sufficiently uniform recrystallized microstructures cannot be obtained.

Further, according to JP H02-101121A, shear strain in the surface layer of the hot rolled sheet increases by controlling finish hot rolling condition. However, recrystallization is hard to occur in the center layer in sheet thickness direction of a steel sheet where shear strain is difficult to be introduced, and there still remained a problem in facilitating recrystallization in the center layer.

Further, it is assumed that JP H02-101121A and JP S61-34117A mainly focus on high reduction rolling in a temperature range of high γ phase volume fraction. However, since the temperature range of the maximum γ phase volume fraction greatly varies depending on the material compositions, there was a problem that, when using certain compositions, high reduction rolling is performed in a temperature range out of the temperature range of maximum γ phase volume fraction, which results in an insufficient improving effect of magnetic properties.

SUMMARY

We discovered the relation between the addition amount of Si, C, and Ni which are known compositions in grain oriented electrical steel sheets, and the α single phase transition temperature ($T_\alpha$) as well as the maximum γ phase volume fraction temperature ($T_{\gamma max}$). Further, we discovered that it is important to perform high reduction rolling at a temperature equal to or higher than ($T_\alpha$−100) ° C. which was obtained from the α single phase transition temperature in the first pass of the rough rolling process of hot rolling, and to perform high reduction rolling at a temperature range of ($T_{\gamma max}$±50)° C. obtained from the maximum γ phase volume fraction temperature in any one pass of the finish hot rolling process of hot rolling.

We also discovered that by performing the above hot rolling, ferrite grains in the hot rolled sheet are refined, and that fine and uniform generation of the γ phase provides refinement of the structure of the hot rolled steel sheet, and also that as the refinement of the structure of the hot rolled steel sheet proceeds, it becomes possible to better control the texture of the primary recrystallized sheet.

We thus provide a method of manufacturing a grain oriented electrical steel sheet using austenite (γ)-ferrite (α) transformation which develops excellent magnetic properties after secondary recrystallization by performing high reduction rolling at a predetermined temperature range based on the material compositions in the first pass of a rough rolling process and at least one pass of a finish rolling process during hot rolling.

In addition to the above technique, we achieve further improvement in the magnetic properties of the grain oriented electrical steel sheet by controlling the heating rate of the predetermined temperature range in the heating process of primary recrystallization annealing by performing magnetic domain refining treatment.

We thus specifically provide:

1. A method of manufacturing a grain oriented electrical steel sheet, the method comprising:

heating a steel slab including by mass %

Si: 3.0% or more and 4.0% or less,

C: 0.020% or more and 0.10% or less,

Ni: 0.005% or more and 1.50% or less,

Mn: 0.005% or more and 0.3% or less,

Acid-Soluble Al: 0.01% or more and 0.05% or less,

N: 0.002% or more and 0.012% or less, at least one element selected from S and Se in a total of 0.05% or less, and the balance being Fe and incidental impurities;

then subjecting the slab to hot rolling to obtain a hot rolled steel sheet;

subjecting or not subjecting the steel sheet to subsequent hot band annealing;

then subjecting the steel sheet to cold rolling once, or twice or more with intermediate annealing performed therebetween to have a final sheet thickness;

then subjecting the steel sheet to primary recrystallization annealing and further secondary recrystallization annealing to manufacture a grain oriented electrical steel sheet, wherein in a rough rolling process of the hot rolling, when the α single phase transition temperature calculated by the following equation (1) is defined as $T_\alpha$, a first pass of the rough rolling is performed at a temperature of $(T_\alpha-100)$° C. or higher with a rolling reduction of 30% or more, and wherein in a finish rolling process of the hot rolling, when the maximum γ phase volume fraction temperature calculated by the following equation (2) is defined as $T_{\gamma max}$, at least one pass of the finish rolling is performed in a temperature range of $(T_{\gamma max}\pm50)$° C. with a rolling reduction of 40% or more:

$$T_\alpha[°\text{ C.}]=1383.98-73.29[\%\text{ Si}]+2426.33[\%\text{ C}]+271.68[\%\text{ Ni}] \quad (1)$$

$$T_{\gamma max}[°\text{ C.}]=1276.47-59.24[\%\text{ Si}]+919.22[\%\text{ C}]+149.03[\%\text{ Ni}] \quad (2)$$

where [% A] represents content of element "A" in steel (mass %).

2. The method of manufacturing a grain oriented electrical steel sheet according to aspect 1, wherein the steel slab further includes by mass %, one or more of Sn: 0.005% or more and 0.50% or less, Sb: 0.005% or more and 0.50% or less, Cu: 0.005% or more and 1.5% or less, and P: 0.005% or more and 0.50% or less.

3. The method of manufacturing a grain oriented electrical steel sheet according to aspect 1 or 2, wherein a heating rate from 500° C. to 700° C. in the primary recrystallization annealing is 50° C./s or more.

4. The method of manufacturing a grain oriented electrical steel sheet according to any one of aspects 1 to 3, wherein the steel sheet is subjected to magnetic domain refining treatment at any stage after the cold rolling.

5. The method of manufacturing a grain oriented electrical steel sheet according to any one of aspects 1 to 3, wherein the steel sheet after the secondary recrystallization is subjected to magnetic domain refining treatment by electron beam irradiation.

6. The method of manufacturing a grain oriented electrical steel sheet according to any one of aspects 1 to 3, wherein the steel sheet after the secondary recrystallization is subjected to magnetic domain refining treatment by continuous laser irradiation.

7. The method of manufacturing a grain oriented electrical steel sheet according to any one of aspects 1 to 6, wherein at least one pass of the finish rolling is performed in a temperature range of $(T_{\gamma max}\pm50)$° C. at a strain rate of 6.0 $s^{-1}$ or more.

Since the method of manufacturing a grain oriented electrical steel sheet can control the texture of the primary recrystallized sheet so that the orientation of the product steel sheet is highly in accord with the Goss orientation, it becomes possible to manufacture the grain oriented electrical steel sheet having excellent magnetic properties compared to before, after secondary recrystallization annealing. In particular, the grain oriented electrical steel sheet can achieve excellent iron loss properties with iron loss $W_{17/50}$ after secondary recrystallization annealing of 0.85 W/kg or less, even with a thin steel sheet with a sheet thickness of 0.23 mm which is generally difficult to manufacture.

BRIEF DESCRIPTION OF THE DRAWINGS

Our steel sheets and methods will be further described below with reference to the accompanying drawings, wherein.

DETAILED DESCRIPTION

Figure 1:
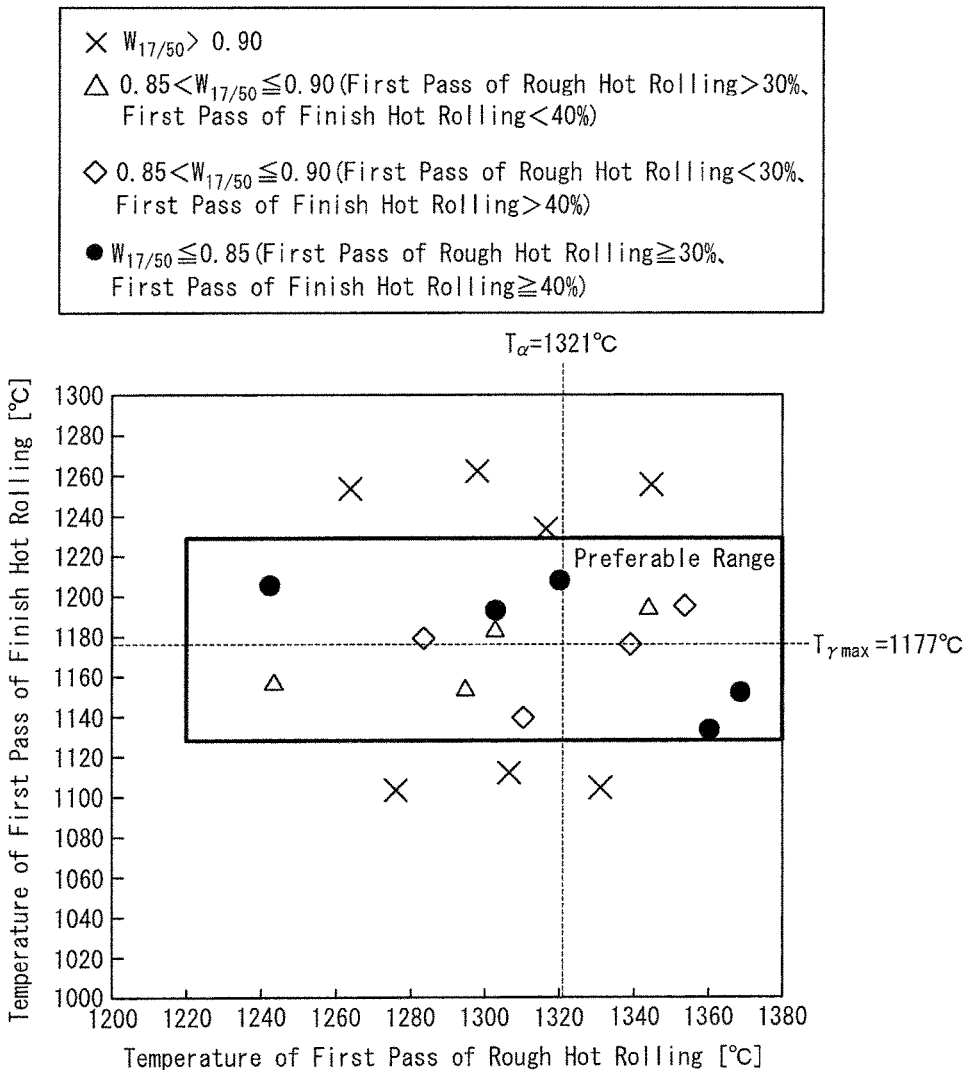
FIG. 1 is a graph showing the influence of the temperature and rolling reduction in the first pass of rough hot rolling and in the first pass of finish hot rolling on the magnetic properties of a final annealed steel sheet (Material No. 3)

Unless otherwise specified, the indication of "%" regarding compositions of the steel sheet shall stand for "mass %".

Si: 3.0% or More to 4.0% or Less

Si is an element that is extremely effective to enhance electrical resistance of steel and reduce eddy current loss which constitutes a part of iron loss. By adding Si to the steel sheet, electrical resistance monotonically increases until the content reaches 11%. However, when the content exceeds 4.0%, workability significantly decreases. On the other hand, if the content is less than 3.0%, electrical resistance becomes too small and good iron loss properties cannot be obtained. Therefore, the amount of Si is 3.0% or more to 4.0% or less.

C: 0.020% or More to 0.10% or Less

C is a necessary element to improve the hot rolled texture by using austenite-ferrite transformation during hot rolling and the soaking time of hot band annealing. However, when C content exceeds 0.10%, not only does the burden of decarburization treatment increase but the decarburization itself becomes incomplete, and becomes the cause of magnetic aging in the product steel sheet. On the other hand, if C content is less than 0.020%, the improving effect of the hot rolled texture is small, and it becomes difficult to obtain a desirable primary recrystallized texture. Therefore, the amount of C is 0.020% or more to 0.10% or less.

Ni: 0.005% or More to 1.50% or Less

Ni is an austenite forming element and therefore it is an element useful to improve the texture of a hot-rolled sheet and improving magnetic properties using austenite transformation. However, if Ni content is less than 0.005%, it is less effective in improving magnetic properties. On the other hand, if the content is over 1.50%, workability decreases and leads to deterioration of sheet threading performance, and also causes unstable secondary recrystallization and leads to deterioration of magnetic properties. Therefore, the amount of Ni is 0.005% to 1.50%.

Mn: 0.005% or More to 0.3% or Less

Mn is an important element in a grain oriented electrical steel sheet since it serves as an inhibitor in suppressing normal grain growth by MnS and MnSe in the heating process of secondary recrystallization annealing. If Mn content is less than 0.005%, the absolute content of the inhibitor will be insufficient and, therefore, the inhibition effect on normal grain growth will be insufficient. On the other hand, if Mn content exceeds 0.3%, not only will it be necessary to perform slab heating at a high temperature to completely dissolve Mn in the process of heating the slab before hot rolling, but the inhibitor will be formed as a coarse precipitate, and therefore the inhibition effect on normal grain growth will be insufficient. Therefore, the amount of Mn is 0.005% or more to 0.3% or less.

Acid-Soluble Al: 0.01% or More to 0.05% or Less

Acid-Soluble Al is an important element in a grain oriented electrical steel sheet since AlN serves as an inhibitor in suppressing normal grain growth in the heating process of secondary recrystallization annealing. If Acid-Soluble Al content is less than 0.01%, the absolute content of the inhibitor is insufficient, and therefore the inhibition effect on normal grain growth will be insufficient. On the other hand, if Acid-Soluble Al content exceeds 0.05%, AlN is formed as a coarse precipitate, and therefore inhibition effect on normal grain growth will be insufficient. Therefore, the amount of Acid-Soluble Al is 0.01% or more to 0.05% or less.

N: 0.002% or More to 0.012% or Less

N bonds with Al to form an inhibitor. However, if N content is less than 0.002%, the absolute content of the inhibitor will be insufficient, and therefore inhibition effect on normal grain growth will be insufficient. On the other hand, if the content exceeds 0.012%, holes called blisters will be generated during cold rolling, and the appearance of the steel sheet will be deteriorated. Therefore, the amount of N is 0.002% or more to 0.012% or less. Total of at least one element selected from S and Se: 0.05% or less S and Se bond with Mn to form an inhibitor. However, if the content exceeds 0.05%, desulfurization and deselenization become incomplete in secondary recrystallization annealing which causes deterioration of iron loss properties. Therefore, the total amount of at least one element selected from S and Se is 0.05% or less. Further, although there is no particular lower limit for these elements, it is preferable to include them in an amount of about 0.01% or more in order to obtain their addition effect.

Although the basic components are as explained above, the following elements may also be added as necessary.

Sn: 0.005% or More to 0.50% or Less, Sb: 0.005% or More to 0.50% or Less, Cu: 0.005% or More to 1.5% or Less, and P: 0.005% or More to 0.50% or Less Sn, Sb, Cu and P are useful elements to improve magnetic properties. However, if the content of each element is less than the lower limit value of each of the above ranges, improving effect of magnetic properties is poor, while if the content of each element exceeds the upper limit value of each of the above ranges, secondary recrystallization becomes unstable and magnetic properties deteriorate. Therefore, each element may be contained in the following ranges.

Sn: 0.005% or More to 0.50% or Less, Sb: 0.005% or More to 0.50% or Less, Cu: 0.005% or More to 1.5% or Less, and P: 0.005% or More to 0.50% or Less A steel slab having the above composition is heated and subjected to hot rolling.

A major feature is that in the rough rolling process of the above hot rolling (also simply referred to as rough hot rolling in the present invention) and the finish rolling process (also referred to as finish hot rolling in the present invention), when defining the α single phase transition temperature and the maximum γ phase volume fraction temperature obtained from the addition amount of Si, C, and Ni as $T_\alpha$ and $T_{\gamma max}$ respectively, high reduction rolling is performed with the surface temperature set to $(T_\alpha-100)$° C. or higher in the first pass of rough hot rolling, and high reduction rolling is performed with the surface temperature set to $(T_{\gamma max}\pm50)$° C. in at least one pass of the process of finish hot rolling.

Hereinbelow, reference will be made to experiments. Regarding each of the slabs of steel compositions shown in Table 1, thermal expansion coefficient in the heating process was measured using Formastor dilatometer, and $T_\alpha$ was obtained from the change in its slope. That is, since the atomic packing factor is lower in a phase (bcc structure) compared to γ phase (fcc structure), it is possible to confirm transition of a single phase from the sharp change in thermal expansion coefficient.

TABLE 1

| No. | Si [mass. %] | C [mass. %] | Ni [mass. %] | Mn [mass. %] | sol. Al [mass. %] | N [mass. %] | S [mass. %] | Se [mass. %] | $T_\alpha$ [° C.] (Measured Value) | $T_{\gamma max}$ [° C.] (Measured Value) |
|---|---|---|---|---|---|---|---|---|---|---|
| 1 | 3.0 | 0.02 | 0.005 | 0.08 | 0.02 | 0.01 | 0.01 | 0.02 | 1159 | 1099 |
| 2 | 3.0 | 0.02 | 0.2 | 0.08 | 0.03 | 0.01 | 0.01 | 0.02 | 1278 | 1158 |
| 3 | 3.0 | 0.02 | 0.4 | 0.09 | 0.02 | 0.01 | 0.01 | 0.02 | 1343 | 1181 |
| 4 | 3.0 | 0.05 | 0.005 | 0.08 | 0.03 | 0.01 | 0.01 | 0.02 | 1316 | 1162 |
| 5 | 3.0 | 0.05 | 0.2 | 0.08 | 0.03 | 0.01 | 0.01 | 0.02 | 1359 | 1181 |
| 6 | 3.0 | 0.05 | 0.4 | 0.08 | 0.03 | 0.01 | 0.01 | 0.02 | 1396 | 1195 |
| 7 | 3.0 | 0.08 | 0.005 | 0.09 | 0.02 | 0.01 | 0.01 | 0.02 | 1372 | 1181 |
| 8 | 3.0 | 0.08 | 0.2 | 0.09 | 0.03 | 0.01 | 0.01 | 0.02 | 1402 | 1195 |
| 9 | 3.0 | 0.08 | 0.4 | 0.08 | 0.03 | 0.01 | 0.01 | 0.02 | 1429 | 1205 |
| 10 | 3.5 | 0.02 | 0.2 | 0.08 | 0.02 | 0.01 | 0.01 | 0.02 | 1193 | 1106 |
| 11 | 3.5 | 0.02 | 0.4 | 0.08 | 0.03 | 0.01 | 0.01 | 0.02 | 1302 | 1159 |
| 12 | 3.5 | 0.05 | 0.005 | 0.09 | 0.03 | 0.01 | 0.01 | 0.02 | 1263 | 1121 |
| 13 | 3.5 | 0.05 | 0.2 | 0.09 | 0.03 | 0.01 | 0.01 | 0.02 | 1322 | 1157 |
| 14 | 3.5 | 0.05 | 0.4 | 0.08 | 0.02 | 0.01 | 0.01 | 0.02 | 1371 | 1180 |
| 15 | 3.5 | 0.08 | 0.005 | 0.09 | 0.03 | 0.01 | 0.01 | 0.02 | 1336 | 1157 |
| 16 | 3.5 | 0.08 | 0.2 | 0.08 | 0.03 | 0.01 | 0.01 | 0.02 | 1374 | 1178 |
| 17 | 3.5 | 0.08 | 0.4 | 0.08 | 0.02 | 0.01 | 0.01 | 0.02 | 1410 | 1195 |
| 18 | 4.0 | 0.02 | 0.4 | 0.08 | 0.03 | 0.01 | 0.01 | 0.02 | 1242 | 1118 |

TABLE 1-continued

| No. | Si [mass. %] | C [mass. %] | Ni [mass. %] | Mn [mass. %] | sol. Al [mass. %] | N [mass. %] | S [mass. %] | Se [mass. %] | $T_\alpha$ [° C.] (Measured Value) | $T_{\gamma max}$ [° C.] (Measured Value) |
|---|---|---|---|---|---|---|---|---|---|---|
| 19 | 4.0 | 0.05 | 0.005 | 0.08 | 0.03 | 0.01 | 0.01 | 0.02 | 1192 | 1048 |
| 20 | 4.0 | 0.05 | 0.2 | 0.09 | 0.03 | 0.01 | 0.01 | 0.02 | 1273 | 1115 |
| 21 | 4.0 | 0.05 | 0.4 | 0.09 | 0.03 | 0.01 | 0.01 | 0.02 | 1337 | 1155 |
| 22 | 4.0 | 0.08 | 0.005 | 0.08 | 0.02 | 0.01 | 0.01 | 0.02 | 1292 | 1117 |
| 23 | 4.0 | 0.08 | 0.2 | 0.08 | 0.02 | 0.01 | 0.01 | 0.02 | 1340 | 1150 |
| 24 | 4.0 | 0.08 | 0.4 | 0.08 | 0.03 | 0.01 | 0.01 | 0.02 | 1384 | 1175 |

Further, regarding $T_{\gamma max}$, a thermodynamic calculation software (Thermo-Calc) was used to estimate the temperature where the component reaches the maximum γ phase volume fraction. Then, a simulated thermal cycle tester was used to perform soaking treatment for 30 minutes in the range of ±30° C. of the estimated temperature with an increment of 5° C., and then rapid cooling was performed to freeze the microstructure. Regarding the steel sheet microstructure for each temperature, microstructure observation was performed using an optical microscope, to measure the pearlite fraction in the range of approximately 130 μm×100 μm, and a mean value of 5 views was defined as γ phase volume fraction.

Then, the relations between test temperatures and measurement results of γ phase volume fraction were plotted, and the maximum value of the γ phase volume fraction was obtained by a curved approximation of the plots, and the temperature of the maximum value was defined as $T_{\gamma max}$.

The results of $T_{\gamma max}$ obtained by the above procedures are shown in Table 1. Based on the results of the same table, the relations of the addition amount of Si, C and Ni, and $T_\alpha$ and $T_{\gamma max}$ are obtained from multiple regression calculation, and they are expressed by equations (1) and (2):

$$T_\alpha[°\ C.]=1383.98-73.29[\%\ Si]+2426.33[\%\ C]+271.68[\%\ Ni] \quad (1)$$

$$T_{\gamma max}[°\ C.]=1276.47-59.24[\%\ Si]+919.22[\%\ C]+149.03[\%\ Ni] \quad (2)$$

where [% A] represents content of element "A" in steel (mass %).

Next, experiments of changing hot rolling conditions regarding slabs of the steel compositions shown in Nos. 3, 15 and 20 of Table 1 were conducted. The values obtained by equations (1) and (2) were used as $T_\alpha$ and $T_{\gamma max}$. Regarding material No. 3, $T_\alpha$=1321° C. and $T_{\gamma max}$=1177° C. Regarding material No. 15, $T_\alpha$=1323° C. and $T_{\gamma max}$=1144° C. Regarding material No. 20, $T_\alpha$=1266° C. and $T_{\gamma max}$=1116° C.

Each slab shown in Table 1 was heated to a temperature of 1400° C., subjected to rough hot rolling and finish hot rolling with various conditions regarding temperature and rolling reduction of the first pass, and then the steel sheet was subjected to hot rolling until reaching sheet thickness of 2.6 mm thick, and then subjected to hot band annealing at 1050° C. for 40 seconds. Then, the steel sheet was subjected to the first cold rolling until reaching a sheet thickness of 1.7 mm thick and then subjected to intermediate annealing at 1100° C. for 60 seconds. Further, the steel sheet was subjected to cold rolling until reaching a sheet thickness of 0.23 mm thick, and then the steel sheet was subjected to primary recrystallization annealing combined with decarburization annealing at 800° C. for 120 seconds. Then, an annealing separator mainly composed of MgO was applied to the surface of the steel sheet, and the steel sheet was subjected to secondary recrystallization annealing combined with purification annealing at 1150° C. for 50 hours to obtain a test piece under each condition.

Figure 2:
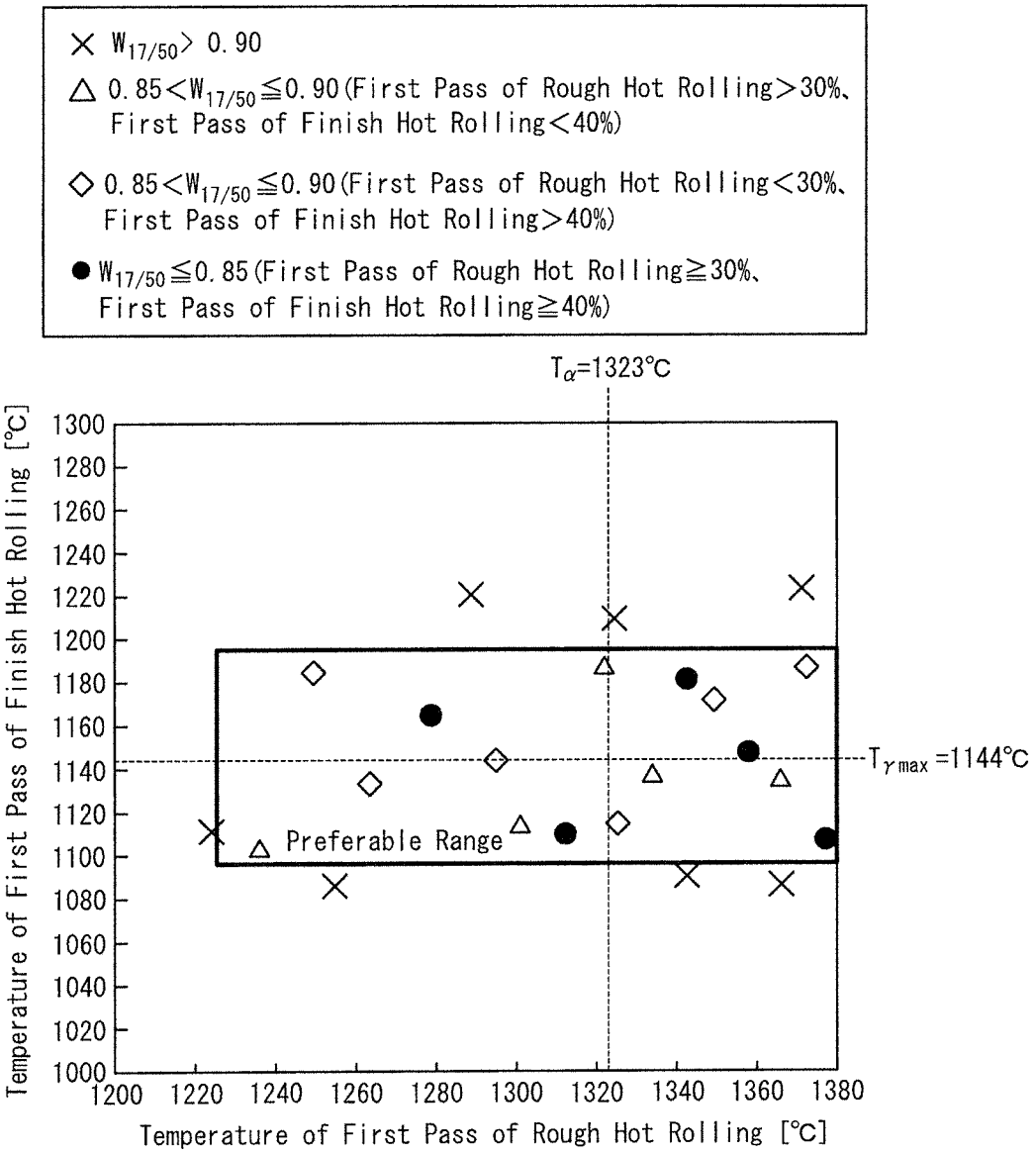
FIG. 2 is a graph showing the influence of the temperature and rolling reduction in the first pass of rough hot rolling and in the first pass of finish hot rolling on the magnetic properties of another final annealed steel sheet (Material No. 15)
Figure 3:
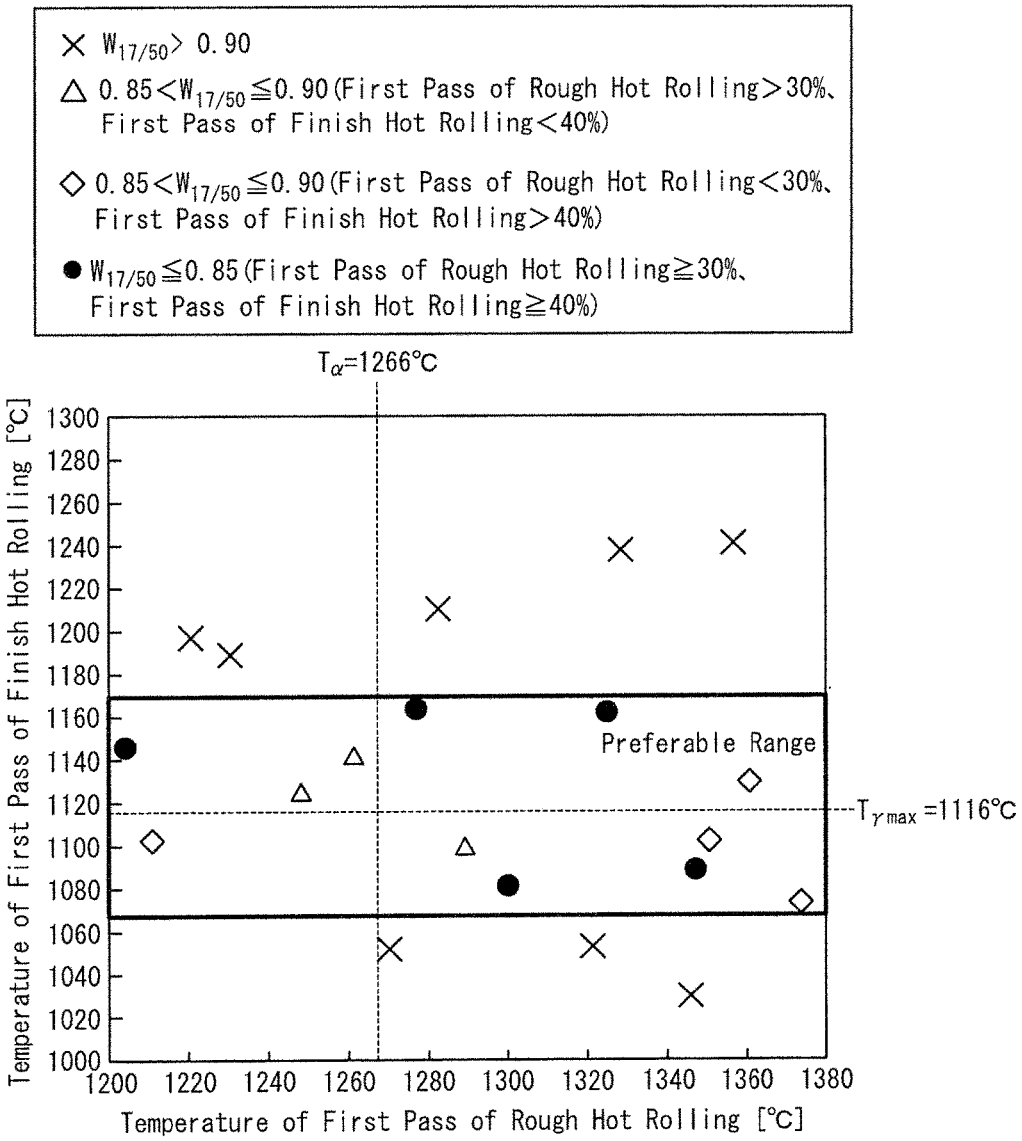
FIG. 3 is a graph showing the influence of the temperature and rolling reduction in the first pass of rough rolling and in the first pass of finish rolling on the magnetic properties of another final annealed steel sheet (Material No. 20).

FIGS. 1 to 3 show the magnetic properties of material Nos. 3, 15 and 20 in table 1. FIGS. 1 to 3 show that good magnetic properties can be obtained by performing the first pass of rough rolling at a temperature of ($T_\alpha$−100)° C. or higher with a rolling reduction of 30% or more, and the first pass of finish hot rolling at a temperature of ($T_{\gamma max}$±50)° C. with a rolling reduction of 40% or more.

Although the upper limit of the temperature of the first pass of rough hot rolling is not specified, considering air cooling after high temperature slab heating, a temperature of around 1350° C. is preferable. Further, the upper limit of rolling reduction is preferably around 60% in terms of the bite angle. Further, rough hot rolling is performed with the total pass of around 2 to 7 passes. The temperature and the rolling reduction from the second pass and after are not particularly limited and the temperature may be around ($T_\alpha$−150)° C. or higher, and the rolling reduction may be around 20% or more.

On the other hand, the upper limit of the rolling reduction of finish hot rolling is preferably around 80% in terms of the bite angle. Further, finish rolling is performed with the total pass of around 4 to 7 passes. We found that performing finish hot rolling with a rolling reduction of 40% or more in a temperature range of ($T_{\gamma max}$±50)° C. even at any pass of the second pass and after would lead to the desired effect. Therefore, in the finish hot rolling process, it is sufficient to perform at least one pass of finish rolling in the temperature range of ($T_{\gamma max}$±50)° C. with a rolling reduction of 40% or more.

By performing rough hot rolling and finish hot rolling satisfying the above conditions, an improving effect on texture such as mentioned above is obtained, and good magnetic properties can be obtained in the product steel sheet. Further, by performing one pass of finish hot rolling in a temperature range of ($T_{\gamma max}$±50)° C. at a strain rate of 6.0 $s^{-1}$ or more, refinement of the γ phase during finish hot rolling becomes prominent, and improving effect of the texture of the primary recrystallized sheet and improving effect of magnetic properties of the secondary recrystallized sheet becomes prominent.

Further, the microstructure of the hot rolled sheet can be improved by performing hot band annealing, if necessary. Hot band annealing at this time is preferably performed under the conditions of soaking temperature of 800° C. or higher and 1200° C. or lower and soaking duration of 2 seconds or more and 300 seconds or less.

With a soaking temperature of hot band annealing of lower than 800° C., the microstructure of the hot rolled sheet is not completely improved and non-recrystallized parts remain. Therefore, a desirable microstructure may not be obtained. On the other hand, if the soaking temperature is over 1200° C., dissolution of AlN, MnSe and MnS proceeds, the inhibition effect of inhibitor in the secondary recrystallization process becomes insufficient, and secondary recrystallization is suspended accordingly, resulting in deterioration of magnetic properties. Therefore, soaking temperature of hot band annealing is preferably 800° C. or higher and 1200° C. or lower.

Further, if the soaking duration is less than 2 seconds, non-recrystallized parts remain because of the short high-temperature holding time, and a desirable microstructure may not be obtained. On the other hand, if the soaking duration is over 300 seconds, dissolution of AlN, MnSe and MnS proceeds, the inhibition effect of inhibitor in the secondary recrystallization process becomes insufficient, so that secondary recrystallization is suspended, resulting in deterioration of magnetic properties.

Therefore, soaking duration of hot band annealing is preferably 2 seconds or more and 300 seconds or less.

After hot band annealing or without hot band annealing by subjecting the steel sheet to cold rolling once, or twice or more with intermediate annealing performed therebetween until reaching the final sheet thickness, it is possible to obtain our grain oriented electrical steel sheet.

The conditions for intermediate annealing may be in accordance with conventionally known conditions. Preferably, soaking temperature is 800° C. or higher and 1200° C. or lower and soaking duration is 2 seconds or more and 300 seconds or less. In the cooling process after intermediate annealing, it is preferable to perform rapid cooling with a cooling rate from 800° C. to 400° C. of 10° C./s or more and 200° C./s or less.

If the above soaking temperature is lower than 800° C., non-recrystallized microstructures remain, and therefore it becomes difficult to obtain a microstructure of uniformly-sized grains in the microstructure of the primary recrystallized sheet and a desirable growth of secondary recrystallized grains cannot be achieved, thereby leading to deterioration of magnetic properties. On the other hand, if the soaking temperature is over 1200° C., dissolution of AlN, MnSe and MnS proceeds, the inhibition effect of inhibitor in the secondary recrystallization process becomes insufficient, and secondary recrystallization is suspended, which may result in deterioration of magnetic properties.

Therefore, soaking temperature of intermediate annealing before final cold rolling is preferably 800° C. or higher and 1200° C. or lower.

Further, if the soaking duration is less than 2 seconds, non-recrystallized parts remain because of the short high-temperature holding time, and it becomes difficult to obtain a desirable microstructure. On the other hand, if the soaking duration is over 300 seconds, dissolution of AlN, MnSe and MnS proceeds, the inhibition effect of inhibitor in the secondary recrystallization process becomes insufficient, so that secondary recrystallization is suspended, resulting in deterioration of magnetic properties.

Therefore, soaking duration of intermediate annealing before final cold rolling is preferably 2 seconds or more and 300 seconds or less.

Further, in the cooling process after intermediate annealing before final cold rolling, if the cooling rate from 800° C. to 400° C. is less than 10° C./s, coarsening of carbides becomes more likely to proceed, and the texture improving effect from the subsequent cold rolling to primary recrystallization annealing decreases, and magnetic properties are more likely to deteriorate. On the other hand, if the cooling rate from 800° C. to 400° C. is over 200° C./s, hard martensite phase is more easily generated, and a desirable microstructure cannot be obtained in the microstructure of the primary recrystallized sheet, thereby leading to deterioration of magnetic properties.

Therefore, the cooling rate from 800° C. to 400° C. in the cooling process after intermediate annealing before final cold rolling is preferably 10° C./s or more and 200° C./s or less.

By setting the rolling reduction in final cold rolling to 80% or more and 92% or less, it is possible to obtain an even better texture of the primary recrystallized sheet.

Steel sheets rolled until reaching final sheet thickness by final cold rolling are preferably subjected to primary recrystallization annealing at a soaking temperature of 700° C. or higher and 1000° C. or lower. In this case, the primary recrystallization annealing may be performed in, for example, wet hydrogen atmosphere to obtain the effect of decarburization of the steel sheet.

If the soaking temperature in primary recrystallization annealing is lower than 700° C., non-recrystallized parts remain, and a desirable microstructure may not be obtained. On the other hand, if the soaking temperature is over 1000° C., secondary recrystallization of Goss orientation grains may occur.

Therefore, primary recrystallization annealing is preferably performed at a temperature of 700° C. or higher and 1000° C. or lower.

By performing common primary recrystallization annealing satisfying the above conditions, texture improving effect such as mentioned above is achieved. By performing primary recrystallization annealing where the heating rate from 500° C. to 700° C. until reaching soaking temperature of primary recrystallization annealing is 50° C./s or more, it is possible to obtain an even higher S orientation ({1 2 4 1}<0 1 4>) intensity or Goss orientation intensity of textures of primary recrystallized sheets and hence it becomes possible to increase the magnetic flux density of the steel sheet after secondary recrystallization and decrease the recrystallized grain size to improve iron loss properties.

Regarding the temperature range of primary recrystallization annealing, since an object of primary recrystallization annealing is to cause recrystallization by performing rapid heating in the temperature range corresponding to recovery of microstructure after cold rolling, the heating rate from 500° C. to 700° C. corresponding to the recovery of microstructure is important and it is preferable that the heating rate of this range is defined. Specifically, if the heating rate in the aforementioned temperature range is less than 50° C./s, recovery of the microstructure in the temperature cannot be sufficiently suppressed and, therefore, the heating rate is preferably 50° C./s or more. Although there is no upper limit for the above heating rate, it is preferably 300° C./s from the limitation of facilities.

Further, primary recrystallization annealing is normally combined with decarburization annealing and should be performed in an appropriate oxidizing atmosphere (e.g. $P_{H2O}/P_{H2}>0.1$). Regarding the above range of 500° C. to 700° C. where a high heating rate is required, there may be situations where due to limitations of facilities and the like it is difficult to introduce oxidizing atmosphere. However, in the light of decarburization, the oxidizing atmosphere in the vicinity of 800° C. is important. Therefore, there would be no problem even if the temperature range of 500° C. to 700° C. is a range of $P_{H2O}/P_{H2}0.1$.

If it is difficult to perform these annealing procedures, a separate decarburizing annealing process may be provided.

It is also possible to perform nitriding treatment of 150 ppm to 250 ppm of N in steel after completion of primary recrystallization annealing and before beginning of secondary recrystallization annealing. To do so, known techniques of performing heat treatment in $NH_3$ atmosphere, adding nitride in annealing separators, changing the atmosphere of secondary recrystallization annealing to nitriding atmosphere may be applied after primary recrystallization annealing.

Then, if necessary, an annealing separator mainly composed of MgO can be applied on the steel sheet surface, and then secondary recrystallization annealing can be performed. Annealing conditions of the secondary recrystallization annealing are not particularly limited, and conventionally known annealing conditions may be applied. Further, by making the annealing atmosphere a hydrogen atmosphere, it is also possible to obtain the effect of purification annealing. Then, after an insulating coating applying process and a flattening annealing process, a desired grain oriented electrical steel sheet is obtained. There is no particular provision regarding the manufacturing conditions of the insulating coating applying process and the flattening annealing process, and they may be performed in accordance with conventional manners.

A grain oriented electrical steel sheet manufactured by satisfying the above conditions have an extremely high magnetic flux density as well as low iron loss properties after secondary recrystallization.

However, achieving the high magnetic flux density, means that the crystal grains were allowed to preferentially grow only in orientations in the vicinity of the Goss orientation during the secondary recrystallization process. Since it is known that the closer to the Goss orientation the secondary recrystallized grains are, the more the growth rate of secondary recrystallized grains increases, an increase in magnetic flux density indicates that secondary recrystallized grain size is potentially coarse. This is advantageous in terms of reducing hysteresis loss, yet may be disadvantageous in terms of reducing eddy current loss. To advantageously solve such an offsetting problem for the ultimate goal of reducing iron loss, it is possible to perform magnetic domain refining treatment in the present invention.

By performing magnetic domain refining treatment, the increase in eddy current loss caused by coarsening of secondary recrystallized grain size is improved, and together with reduction in hysteresis loss, it is possible to obtain extremely good iron loss properties, even better than those of the aforementioned examples of the grain oriented electrical steel sheets. Both of conventionally known heat resistant and non-heat resistant magnetic domain refining treatment methods may be applied. In particular, by performing magnetic domain refining treatment using an electron beam or a continuous laser to the steel sheet surface after secondary recrystallization, it is possible to allow the magnetic domain refining effect to spread to the inner part in the sheet thickness direction of the steel sheet, leading to even lower iron loss properties compared to other magnetic domain refining treatment such as etching.

EXAMPLES

Example 1

Slabs of steel compositions shown in Table 2 were heated at a temperature of 1420° C., then subjected to the first pass of rough hot rolling with a rolling reduction of 40% at 1280° C., then the steel sheet was subjected to the first pass of finish hot rolling with a rolling reduction of 50% at 1180° C., and then subjected to hot rolling until reaching a sheet thickness of 2.6 mm. Then, the steel sheet was subjected to hot band annealing for 40 seconds at 1050° C. Then, the steel sheet was subjected to cold rolling until reaching a sheet thickness of 1.6 mm, intermediate annealing for 80 seconds at 1080° C., cold rolling until reaching a sheet thickness of 0.23 mm, and then to primary recrystallization annealing combined with decarburization for 120 seconds at 820° C. Then, an annealing separator mainly composed of MgO was applied on the steel sheet surface, and then secondary recrystallization annealing combined with purification was performed for 50 hours at 1150° C.

$T_\alpha$ and $T_{\gamma max}$ calculated from equations (1) and (2) and the results of magnetic measurement of the final annealed sheets are shown in Table 2:

$$T_\alpha[°\ C.]=1383.98-73.29[\%\ Si]+2426.33[\%\ C]+271.68[\%\ Ni] \quad (1)$$

$$T_{\gamma max}[°\ C.]=1276.47-59.24[\%\ Si]+919.22[\%\ C]+149.03[\%\ Ni] \quad (2)$$

where [% A] represents content of element "A" in steel (mass %).

TABLE 2

| No. | Si [mass. %] | C [mass. %] | Ni [mass. %] | Mn [mass. %] | sol. Al [mass. %] | N [mass. %] | S [mass. %] | Se [mass. %] | $T_\alpha$ [° C.] | $T_{\gamma max}$ [° C.] | Product Sheet-Magnetic Properties $W_{17/50}$ [W/kg] | Product Sheet-Magnetic Properties $B_8$ [T] | Remarks |
|---|---|---|---|---|---|---|---|---|---|---|---|---|---|
| 1 | 3.2 | 0.04 | 0.01 | 0.08 | 0.02 | 0.01 | 0.01 | 0.02 | 1249 | 1125 | 0.87 | 1.92 | Comparative Example |
| 2 | 3.4 | 0.07 | 0.2 | 0.08 | 0.03 | 0.01 | 0.01 | 0.02 | 1359 | 1169 | 0.83 | 1.94 | Inventive Example |
| 3 | 3.3 | 0.08 | 0.18 | 0.09 | 0.02 | 0.01 | 0.01 | 0.02 | 1385 | 1181 | 0.84 | 1.94 | Inventive Example |
| 4 | 3.6 | 0.05 | 0.005 | 0.08 | 0.03 | 0.01 | 0.01 | 0.02 | 1243 | 1110 | 0.88 | 1.91 | Comparative Example |
| 5 | 3.1 | 0.06 | 0.31 | 0.08 | 0.03 | 0.01 | 0.01 | 0.02 | 1387 | 1194 | 0.82 | 1.95 | Inventive Example |
| 6 | 3.7 | 0.05 | 0.4 | 0.08 | 0.03 | 0.01 | 0.01 | 0.02 | 1343 | 1163 | 0.79 | 1.95 | Inventive Example |
| 7 | 3.4 | 0.03 | 0.42 | 0.09 | 0.02 | 0.01 | 0.01 | 0.02 | 1322 | 1165 | 0.81 | 1.94 | Inventive Example |
| 8 | 3.6 | 0.06 | 0.2 | 0.09 | 0.03 | 0.01 | 0.01 | 0.02 | 1320 | 1148 | 0.80 | 1.94 | Inventive Example |

Table 2 shows that a material subjected to high reduction rolling in a temperature range of $(T_{\alpha}-100)°$ C. or higher in the first pass of rough hot rolling, and high reduction rolling in a temperature range of $(T_{\gamma max}\pm50)°$ C. in the first pass of finish hot rolling, was provided with excellent magnetic properties. On the other hand, regarding materials of Nos. 1 and 4, it is assumed that the reason why excellent magnetic properties were not obtained is that, due to the fact that the temperature of the first pass of finish hot rolling is higher than the temperature range of maximum γ phase volume fraction which is calculated from the compositions, recrystallized grain refinement of ferrite grains as well as uniform generation of the γ phase was insufficient.

From the above results, it is understood that a grain oriented electrical steel sheet with excellent magnetic properties can be obtained by calculating T, and $T_{\gamma max}$ using equations (1) and (2) based on the steel slab compositions, and performing high reduction rolling of 30% or more in a temperature range of $(T_{\alpha}-100)°$ C. or higher in the first pass of rough hot rolling, and performing high reduction rolling of 40% or more in a temperature range of $(T_{\gamma max}\pm50)°$ C. in the first pass of finish hot rolling.

Example 2

Slabs of steel compositions shown in Table 3 were heated at a temperature of 1420° C., then subjected to the first pass of rough hot rolling with a rolling reduction of 40% at 1280° C., then the steel sheet was subjected to the first pass of finish hot rolling with a rolling reduction of 50% at 1180° C., and then subjected to hot rolling until reaching a sheet thickness of 2.6 mm. Then, the steel sheet was subjected to hot band annealing for 40 seconds at 1050° C. Then, the steel sheet was subjected to cold rolling until reaching a sheet thickness of 1.8 mm, intermediate annealing for 80 seconds at 1080° C., cold rolling until reaching a sheet thickness of 0.27 mm, and then to primary recrystallization annealing combined with decarburization for 120 seconds at 820° C. Then, an annealing separator mainly composed of MgO was applied on the steel sheet surface, and then secondary recrystallization annealing combined with purification was performed for 50 hours at 1150° C.

$T_{\alpha}$ and $T_{\gamma max}$ calculated from equations (1) and (2) and the results of magnetic measurement of the final annealed sheets are shown in Table 3.

TABLE 3

| No. | Si [mass. %] | C [mass. %] | Ni [mass. %] | Mn [mass. %] | sol. Al [mass. %] | N [mass. %] | S [mass. %] | Se [mass. %] |
|---|---|---|---|---|---|---|---|---|
| 1 | 3.4 | 0.06 | 0.15 | 0.08 | 0.03 | 0.01 | 0.01 | 0.02 |
| 2 | 3.5 | 0.07 | 0.20 | 0.09 | 0.02 | 0.01 | 0.01 | 0.02 |
| 3 | 3.3 | 0.08 | 0.10 | 0.08 | 0.02 | 0.01 | 0.01 | 0.02 |
| 4 | 3.4 | 0.06 | 0.17 | 0.08 | 0.02 | 0.01 | 0.01 | 0.02 |
| 5 | 3.5 | 0.06 | 0.31 | 0.08 | 0.03 | 0.01 | 0.01 | 0.02 |

| No. | Sn [mass. %] | Sb [mass. %] | Cu [mass. %] | P [mass. %] | Tα [° C.] | Tγmax [° C.] | Product Sheet-Magnetic Properties $W_{17/50}$ [W/kg] | $B_8$ [T] | Remarks |
|---|---|---|---|---|---|---|---|---|---|
| 1 | tr | tr | tr | tr | 1321 | 1153 | 0.86 | 1.96 | Inventive Example |
| 2 | 0.15 | tr | tr | tr | 1352 | 1163 | 0.85 | 1.95 | Inventive Example |
| 3 | tr | 0.031 | tr | tr | 1363 | 1169 | 0.85 | 1.96 | Inventive Example |
| 4 | tr | tr | 0.1 | tr | 1327 | 1156 | 0.84 | 1.95 | Inventive Example |
| 5 | tr | tr | tr | 0.012 | 1357 | 1170 | 0.85 | 1.95 | Inventive Example |

Table 3 shows that a material subjected to high reduction rolling in a temperature range of $(T_{\alpha}-100)°$ C. or higher in the first pass of rough hot rolling, and high reduction rolling in a temperature range of $(T_{\gamma max}\pm50)°$ C. in the first pass of finish hot rolling, was provided with excellent magnetic properties.

From the above results, it is understood that a grain oriented electrical steel sheet with excellent magnetic properties can be obtained by calculating T, and $T_{\gamma max}$ from equations (1) and (2) based on the steel slab compositions, and performing high reduction rolling of 30% or more in a temperature range of $(T_{\alpha}-100)°$ C. or higher in the first pass of rough hot rolling, and performing high reduction rolling of 40% or more in a temperature range of $(T_{\gamma max}\pm50)°$ C. in the first pass of finish hot rolling.

Example 3

The above mentioned Examples 1 and 2 are results of performing primary recrystallization annealing with a heating rate from 500° C. to 700° C. of 20° C./s. Samples prepared by performing cold rolling under conditions of No. 2 (inventive example) of Example 1 until reaching a sheet thickness of 0.23 mm were used with the heating rate from 500° C. to 700° C. in primary recrystallization annealing being the values shown in Table 4, to further conduct a test of changing the method of magnetic domain refining treatment.

Etching grooves having a width of 150 μm, depth of 15 μm, rolling direction interval of 5 mm were formed in transverse direction (direction orthogonal to the rolling direction) on one side of the steel sheet subjected to cold rolling until reaching a sheet thickness of 0.23 mm. The steel sheet was continuously irradiated on one side with an electron beam in the transverse direction after final annealing under the conditions of an acceleration voltage of 100 kV, irradiation interval of 5 mm, beam current of 3 mA. A laser was continuously irradiated in the transverse direction on one side of the steel sheet after final annealing under the conditions of beam diameter of 0.3 mm, output of 200 W, scanning rate of 100 m/s, irradiation interval of 5 mm.

The measurement results of magnetic properties are shown in Table 4.

TABLE 4

| No. | Primary Recrystallization Annealing Heating Rate (500-700° C.) [° C./s] | Magnetic Domain Refining | Magnetic Properties (After Magnetic Domain Refining) $W_{17/50}$ [W/kg] | $B_8$ [T] | Remarks |
|---|---|---|---|---|---|
| 2-a-0 | 20 | — | 0.83 | 1.94 | Inventive Example |
| 2-a-1 | 20 | Etching | 0.72 | 1.90 | Inventive Example |
| 2-a-2 | 20 | Electron Beam | 0.69 | 1.94 | Inventive Example |
| 2-a-3 | 20 | Continuous Laser | 0.70 | 1.94 | Inventive Example |
| 2-b-0 | 40 | — | 0.81 | 1.95 | Inventive Example |
| 2-b-1 | 40 | Etching | 0.70 | 1.91 | Inventive Example |
| 2-b-2 | 40 | Electron Beam | 0.67 | 1.94 | Inventive Example |
| 2-b-3 | 40 | Continuous Laser | 0.67 | 1.94 | Inventive Example |
| 2-c-0 | 100 | — | 0.76 | 1.95 | Inventive Example |
| 2-c-1 | 100 | Etching | 0.66 | 1.91 | Inventive Example |
| 2-c-2 | 100 | Electron Beam | 0.60 | 1.95 | Inventive Example |
| 2-c-3 | 100 | Continuous Laser | 0.60 | 1.95 | Inventive Example |

Table 4 shows that as the heating rate from 500° C. to 700° C. during primary recrystallization annealing increases, good iron loss properties are obtained. Further, it is also shown that, regarding all of the heating rates, extremely good iron loss properties are obtained by performing magnetic domain refining treatment.

Example 4

Examples 1, 2, and 3 are results of conducting experiments in a temperature range of ($T_{\gamma max}$±50)° C. with a strain rate of 8.0 $s^{-1}$ in the first pass of finish hot rolling. Regarding a material of No. 3 (inventive example) of Example 1, an experiment of changing the strain rate of only one pass of finish hot rolling was performed.

Using a rolling reduction and a rolling speed such as shown in Table 5, the material was subjected to at least one pass of finish hot rolling at 1150° C. which corresponds to ($T_{\gamma max}$±50)° C. under the controlled strain rate, and then the steel sheet was subjected to hot rolling until reaching a sheet thickness of 2.0 mm thick. Then, the steel sheet was subjected to hot band annealing for 60 seconds at 1100° C. Further, the steel sheet was subjected to cold rolling until reaching a sheet thickness of 0.23 mm thick, and then subjected to primary recrystallization annealing combined with decarburization for 120 seconds at 820° C. Then, an annealing separator mainly composed of MgO was applied on the steel sheet surface, and then secondary recrystallization annealing combined with purification was performed for 50 hours at 1150° C. The results of magnetic measurement of the final annealed sheets are shown in Table 5.

TABLE 5

| No. | Pass which is the Subject of the Invention | Conditions for Finish Hot Rolling: First Pass Temp. [° C.] | First Pass Rolling Reduction [%] | First Pass Rolling Rate [mpm] | First Pass Strain Rate [$s^{-1}$] | Second Pass Temp. [° C.] | Second Pass Rolling Reduction [%] | Second Pass Rolling Rate [mpm] | Second Pass Strain Rate [$s^{-1}$] |
|---|---|---|---|---|---|---|---|---|---|
| 3-a-1 | First Pass | 1150 | 40 | 70 | 6.0 | 1100 | 35 | 150 | 12.0 |
| 3-a-2 | First Pass | 1150 | 50 | 70 | 6.8 | 1095 | 35 | 150 | 12.0 |
| 3-a-3 | First Pass | 1150 | 50 | 150 | 14.3 | 1095 | 35 | 180 | 14.4 |
| 3-a-4 | First Pass | 1150 | 70 | 70 | 7.9 | 1085 | 35 | 150 | 12.0 |
| 3-a-5 | First Pass | 1150 | 70 | 150 | 16.9 | 1085 | 35 | 180 | 14.4 |
| 3-b-1 | Second Pass | 1200 | 40 | 70 | 6.0 | 1150 | 40 | 150 | 12.8 |
| 3-b-2 | Second Pass | 1200 | 40 | 70 | 6.0 | 1150 | 50 | 150 | 14.3 |
| 3-b-3 | Second Pass | 1200 | 40 | 70 | 6.0 | 1150 | 50 | 220 | 21.0 |
| 3-b-4 | Second Pass | 1200 | 40 | 70 | 6.0 | 1150 | 70 | 150 | 16.9 |
| 3-b-5 | Second Pass | 1200 | 40 | 70 | 6.0 | 1150 | 70 | 220 | 24.8 |
| 3-c-1 | Third Pass | 1250 | 50 | 70 | 6.7 | 1190 | 45 | 150 | 13.6 |
| 3-c-2 | Third Pass | 1250 | 50 | 70 | 6.7 | 1190 | 45 | 150 | 13.6 |
| 3-c-3 | Third Pass | 1250 | 50 | 70 | 6.7 | 1190 | 45 | 150 | 13.6 |
| 3-c-4 | Third Pass | 1250 | 50 | 70 | 6.7 | 1190 | 45 | 150 | 13.6 |
| 3-c-5 | Third Pass | 1250 | 50 | 70 | 6.7 | 1190 | 45 | 150 | 13.6 |

TABLE 5-continued

| | Conditions for Finish Hot Rolling Third Pass | | | | Magnetic Properties | | |
|---|---|---|---|---|---|---|---|
| No. | Temp. [° C.] | Rolling Reduction [%] | Rolling Rate [mpm] | Strain Rate [$s^{-1}$] | $W_{17/50}$ [W/kg] | $B_8$ [T] | Remarks |
| 3-a-1 | 1070 | 30 | 250 | 18.5 | 0.84 | 1.93 | Inventive Example |
| 3-a-2 | 1060 | 30 | 250 | 18.5 | 0.83 | 1.94 | Inventive Example |
| 3-a-3 | 1060 | 30 | 290 | 21.4 | 0.80 | 1.95 | Inventive Example |
| 3-a-4 | 1040 | 30 | 250 | 18.5 | 0.82 | 1.94 | Inventive Example |
| 3-a-5 | 1040 | 30 | 290 | 21.4 | 0.79 | 1.95 | Inventive Example |
| 3-b-1 | 1100 | 30 | 250 | 18.5 | 0.81 | 1.94 | Inventive Example |
| 3-b-2 | 1090 | 30 | 250 | 18.5 | 0.81 | 1.94 | Inventive Example |
| 3-b-3 | 1090 | 30 | 320 | 23.7 | 0.79 | 1.95 | Inventive Example |
| 3-b-4 | 1075 | 30 | 250 | 18.5 | 0.80 | 1.94 | Inventive Example |
| 3-b-5 | 1075 | 30 | 320 | 23.7 | 0.78 | 1.95 | Inventive Example |
| 3-c-1 | 1150 | 40 | 250 | 21.3 | 0.81 | 1.94 | Inventive Example |
| 3-c-2 | 1150 | 50 | 250 | 23.8 | 0.80 | 1.93 | Inventive Example |
| 3-c-3 | 1150 | 50 | 360 | 34.3 | 0.78 | 1.95 | Inventive Example |
| 3-c-4 | 1150 | 70 | 250 | 28.2 | 0.79 | 1.95 | Inventive Example |
| 3-c-5 | 1150 | 70 | 360 | 40.6 | 0.79 | 1.96 | Inventive Example |

Table 5 shows that good iron loss properties are obtained by performing at least one pass of fihnish hot rolling at the strain rate of 6.0 $s^{-1}$ or more in a temperature range of ($T_{\gamma max}$±50)° C.

The invention claimed is:

1. A method of manufacturing a grain oriented electrical steel sheet, the method comprising:

heating a steel slab including by mass %

Si: 3.0% or more and 4.0% or less,

C: 0.020% or more and 0.10% or less,

Ni: 0.005% or more and 1.50% or less,

Mn: 0.005% or more and 0.3% or less,

Acid-Soluble Al: 0.01% or more and 0.05% or less,

N: 0.002% or more and 0.012% or less, at least one element selected from S and Se in a total of 0.05% or less, and the balance being Fe and incidental impurities;

subjecting the slab to hot rolling to obtain a hot rolled steel sheet;

subjecting the steel sheet to cold rolling once, or twice or more with intermediate annealing performed therebetween to have a final sheet thickness;

subjecting the steel sheet to primary recrystallization annealing and further secondary recrystallization annealing to manufacture a grain oriented electrical steel sheet, wherein in a rough rolling process of the hot rolling, when the α single phase transition temperature calculated by equation (1) is defined as $T_\alpha$, a first pass of the rough rolling is performed at a temperature of ($T_\alpha$−100) ° C. or higher with a rolling reduction of 30% or more, and wherein in a finish rolling process of the hot rolling, when the maximum γ phase volume fraction temperature calculated by equation (2) is defined as $T_{\gamma max}$, at least one pass of the finish rolling is performed in a temperature range of ($T_{\gamma max}$±50) ° C. with a rolling reduction of 40% or more:

$$T_\alpha[°\ C.]=1383.98-73.29[\%\ Si]+2426.33[\%\ C]+271.68[\%\ Ni] \quad (1)$$

$$T_{\gamma max}[°\ C.]=1276.47-59.24[\%\ Si]+919.22[\%\ C]+149.03[\%\ Ni] \quad (2)$$

where [% A] represents content of element "A" in steel (mass %).

2. The method according to claim 1, wherein the steel slab further includes by mass %, one or more of Sn: 0.005% or more and 0.50% or less, Sb: 0.005% or more and 0.50% or less, Cu: 0.005% or more and 1.5% or less, and P: 0.005% or more and 0.50% or less.

3. The method according to claim 1, wherein a heating rate from 500° C. to 700° C. in the primary recrystallization annealing is 50° C./s or more.

4. The method according to claim 2, wherein a heating rate from 500° C. to 700° C. in the primary recrystallization annealing is 50° C./s or more.

5. The method according to claim 1, wherein the steel sheet is subjected to magnetic domain refining treatment at any stage after the cold rolling.

6. The method according to claim 2, wherein the steel sheet is subjected to magnetic domain refining treatment at any stage after the cold rolling.

7. The method according to claim 3, wherein the steel sheet is subjected to magnetic domain refining treatment at any stage after the cold rolling.

8. The method according to claim 1, wherein the steel sheet after the secondary recrystallization is subjected to magnetic domain refining treatment by electron beam irradiation.

9. The method according to claim 2, wherein the steel sheet after the secondary recrystallization is subjected to magnetic domain refining treatment by electron beam irradiation.

10. The method according to claim 3, wherein the steel sheet after the secondary recrystallization is subjected to magnetic domain refining treatment by electron beam irradiation.

11. The method according to claim 1, wherein the steel sheet after the secondary recrystallization is subjected to magnetic domain refining treatment by continuous laser irradiation.

12. The method according to claim 2, wherein the steel sheet after the secondary recrystallization is subjected to magnetic domain refining treatment by continuous laser irradiation.

13. The method according to claim 3, wherein the steel sheet after the secondary recrystallization is subjected to magnetic domain refining treatment by continuous laser irradiation.

14. The method according to claim 1, wherein at least one pass of the finish rolling is performed in a temperature range of ($T_{\gamma max}$±50) ° C. at a strain rate of 6.0 $s^{-1}$ or more.

15. The method according to claim 2, wherein at least one pass of the finish rolling is performed in a temperature range of ($T_{\gamma max}$±50) ° C. at a strain rate of 6.0 $s^{-1}$ or more.

16. The method according to claim 3, wherein at least one pass of the finish rolling is performed in a temperature range of ($T_{\gamma max}$±50) ° C. at a strain rate of 6.0 $s^{-1}$ or more.

17. The method according to claim 5, wherein at least one pass of the finish rolling is performed in a temperature range of ($T_{\gamma max}$±50) ° C. at a strain rate of 6.0 $s^{-1}$ or more.

18. The method according to claim 8, wherein at least one pass of the finish rolling is performed in a temperature range of ($T_{\gamma max}$±50) ° C. at a strain rate of 6.0 $s^{-1}$ or more.

19. The method according to claim 11, wherein at least one pass of the finish rolling is performed in a temperature range of ($T_{\gamma max}$±50) ° C. at a strain rate of 6.0 $s^{-1}$ or more.

20. The method according to claim 1, further comprising subjecting the hot rolled steel sheet to hot band annealing, prior to the cold rolling.

* * * * *